US005622416A

United States Patent [19]

Rainey et al.

[11] Patent Number: 5,622,416

[45] Date of Patent: Apr. 22, 1997

[54] FOOT PEDAL DOOR OPENER DEVICE FOR A TWO-DOOR REACH-IN CABINET

[75] Inventors: Jerry Rainey, Tyrone; Emory Taylor, Canton, both of Ga.

[73] Assignee: Hoshizaki America Inc., Peachtree City, Ga.

[21] Appl. No.: 441,594

[22] Filed: May 15, 1995

[51] Int. Cl.[6] ..... A47B 95/00

[52] U.S. Cl. ..... 312/319.9; 312/324; 292/255; 49/324; 49/263

[58] Field of Search ..... 312/319.9, 139, 312/329, 326, 324; 292/255; 49/324, 263; 16/DIG. 7

[56] References Cited

U.S. PATENT DOCUMENTS

| | | | |
|---|---|---|---|
| 885,570 | 4/1908 | Bergquist | 49/274 |
| 1,109,723 | 9/1914 | White | 312/319.9 X |
| 1,244,910 | 10/1917 | Smith | 292/255 X |
| 1,611,386 | 12/1926 | Stanley | 49/263 |
| 1,631,002 | 5/1927 | Bowman et al. | 312/125 X |
| 1,847,564 | 3/1932 | Hood | 292/255 |
| 1,882,536 | 10/1932 | Weinheimer | 292/255 |
| 2,021,914 | 11/1935 | Goulooze | 292/255 |
| 2,209,294 | 7/1940 | Froelich | 292/255 X |
| 2,904,823 | 9/1959 | Perrill | 292/255 X |
| 3,007,695 | 11/1961 | Bell, Jr. | 49/263 |
| 3,012,837 | 12/1961 | Morrissey, Jr. | 49/276 |
| 4,911,508 | 3/1990 | Tillman | 312/319.9 |

FOREIGN PATENT DOCUMENTS

| | | | |
|---|---|---|---|
| 428408 | 5/1926 | Switzerland | 312/319.9 |
| 665538 | 5/1988 | Switzerland | 312/319.9 |

*Primary Examiner*—Peter M. Cuomo
*Assistant Examiner*—Janet M. Wilkens
*Attorney, Agent, or Firm*—Nikaido, Marmelstein, Murray & Oram LLP

[57] ABSTRACT

A foot pedal door opener device for side-by-side doors of a cabinet includes a right side foot pedal for opening a left side door of the side-by-side doors, and a left side foot pedal for opening a right side door of the side-by-side doors. The right and left side foot pedals are pivotably attached to pivot points on the cabinet. Actuator members are fixedly attached to the right and left side foot pedals. The actuator members are disposed to engage the opposite doors when a foot pedal is actuated, thereby opening the opposite door. The actuator members extend from one foot pedal toward the other foot pedal, such that a portion of the actuator members are in an overlapping, non-interfering relationship.

22 Claims, 4 Drawing Sheets

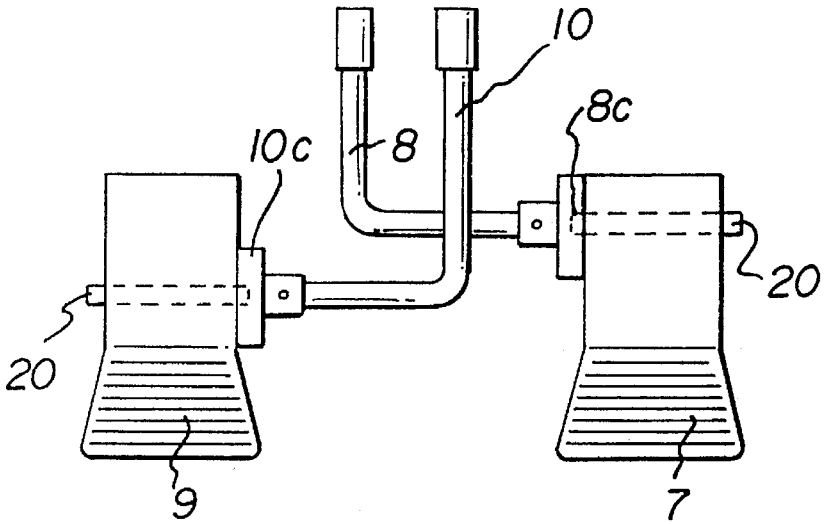
Fig. 6
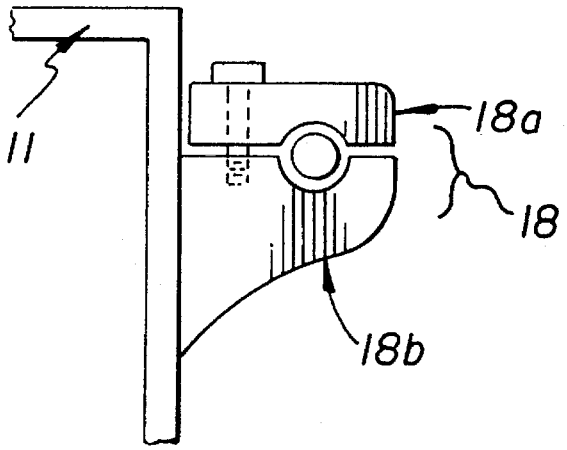
Fig. 7
Fig. 8(a)
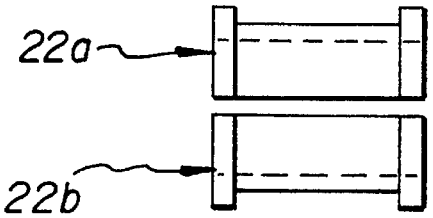
Fig. 8(b)
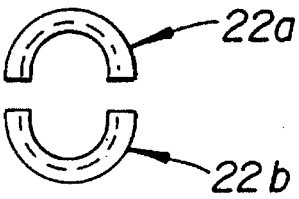

FOOT PEDAL DOOR OPENER DEVICE FOR A TWO-DOOR REACH-IN CABINET

FIELD OF THE INVENTION

1. Field of the Invention

The present invention is directed to a foot pedal door opener device for a two-door commercial reach-in cabinet having a pair of side-by-side doors which are hinged on opposite sides of the housing, and open at a middle section of the cabinet, thereby swinging outward. The foot pedal door opener device allows a user to open the doors while their hands are full, and thereby enter or access the interior of the cabinet with a minimum of inconvenience. The foot pedals are positioned so that a door can be opened while standing directly in front of the foot pedal.

2. Description of the Related Art

Foot pedal door opener devices for various types of cabinets, including refrigerators and freezers, are known in the art. An example of a prior art foot pedal device is shown in U.S. Pat. No. 3,012,837, which is hereby incorporated by reference. This prior art patent illustrates the use of a single foot pedal which is depressed downward by a foot of the user, to swing open a hinged door of a refrigerated cabinet. A significant problem which is caused by the configuration in this patent is that a user must stand directly in front of the door in order to actuate the foot pedal, thereby impeding the opening of the door. Additionally, the single door cabinet configuration allows a simple opening mechanism to be used therefor. U.S. Pat. No. 4,911,508 illustrates a different type of single-cabinet foot pedal door opener, wherein a foot pedal is offset from the opening of the door. However, the foot pedal of this prior art device must be actuated from behind the door. A user must walk along the side of the refrigerator, and depress the actuator in the direction that the door will open, and then walk around to the front of the cabinet to access the interior thereof.

SUMMARY OF THE INVENTION

The invention is directed to a foot pedal door opener device wherein a commercial cabinet, having two side-by-side doors, has two oppositely disposed foot pedals such that a user, having their hands full, can walk up to the front of the cabinet, depress a foot pedal and have the corresponding door open without the need for the user to move out of the way of the door. The configuration of the invention is accomplished with a simple, cost effective, and durable structure. The foot pedal door opener device of the invention includes a right side foot pedal for opening a left side door of the two-door cabinet. The right side foot pedal is pivotably attached to a first pivot point which is fixed on the cabinet. A left side foot pedal is provided for opening a right side door of the two-door cabinet. The left side foot pedal is pivotably attached to a second pivot point on the cabinet, which is adjacent the first pivot point. A first actuator member is fixedly attached to the right side foot pedal. The first actuator member is disposed to engage the left side door when the right side foot pedal is actuated, thereby opening the left side door. A second actuator member is fixedly attached to the left side foot pedal. The second actuator member engages the right side door when the left side foot pedal is actuated, thereby opening the right side door. The first actuator member extends from the right side foot pedal toward the left side foot pedal, and the second actuator member extends from the left side foot pedal toward the right side foot pedal. A portion of the actuator members are in an overlapping, non-interfering relationship with each other.

Biasing means can be used to bias the right side foot pedal and the left side foot pedal, such that the foot pedals return to an original position after being actuated. The biasing means can comprise first and second coil springs disposed between the right and left side foot pedals and the cabinet, respectively. The first and second actuator members each comprise rotating portions extending from a side of the corresponding foot pedal, toward the other foot pedal. The actuator members also include distal portions extending at right angles from the rotating portion, such that the distal portion pivots or swings when the corresponding foot pedal is actuated, thereby engaging and opening the corresponding door.

BRIEF DESCRIPTION OF THE DRAWINGS

Other objects and features of this invention will become understood from the following description, with reference to the accompanying drawings, wherein:

FIG. 6 is a view of another alternative embodiment of the present invention;

FIG. 7 illustrates an alternative embodiment of a pedal mounting block of the present invention; and FIGS. 8*a* and 8*b* illustrate a configuration of a split type bearing for use in the present invention.

DETAILED DESCRIPTION OF THE PREFERRED EMBODIMENTS

Figure 1:
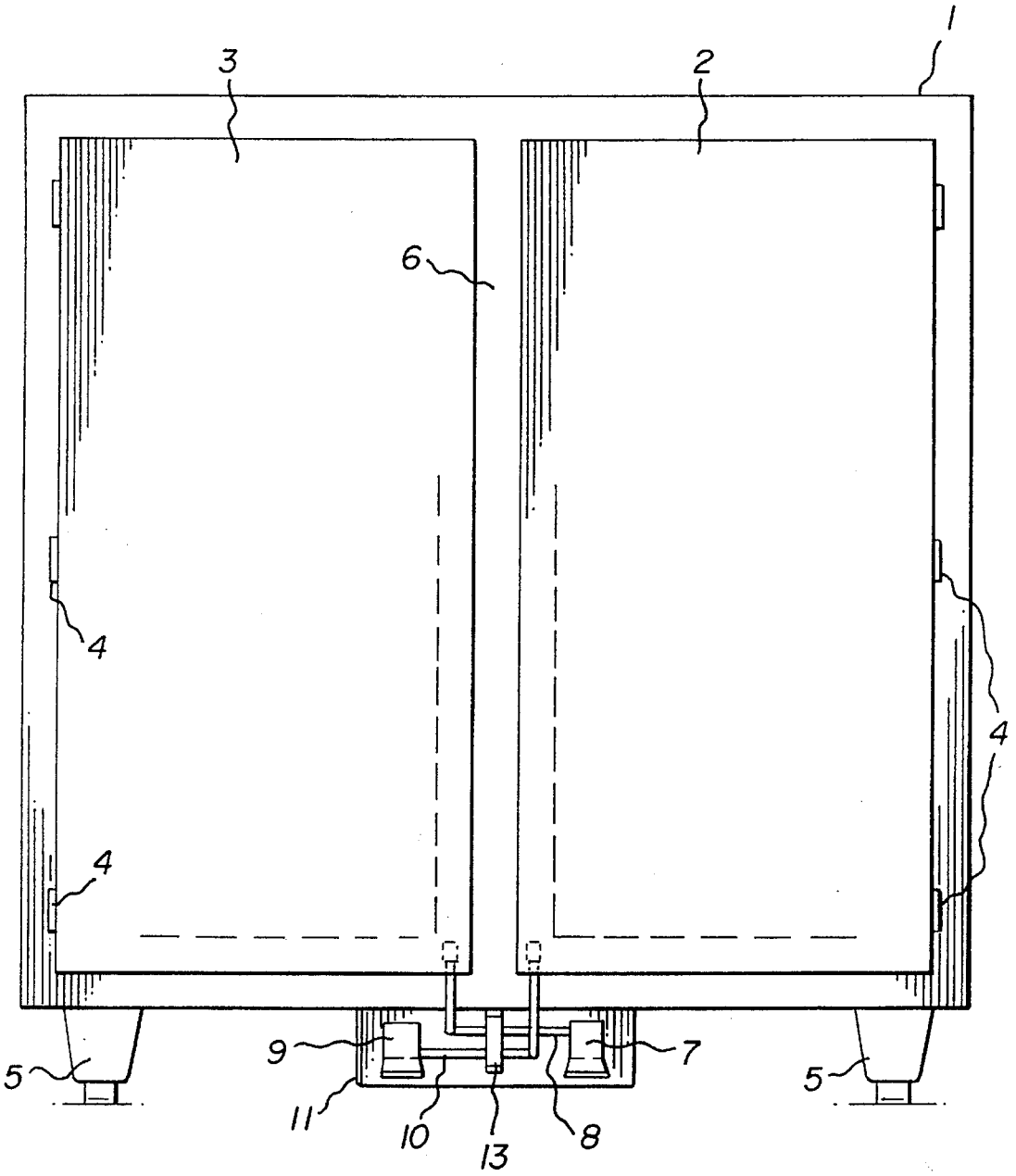
FIG. 1 is a partial head-on view of a side-by-side cabinet having a foot pedal door opener device according to an embodiment of the present invention.

FIG. 1 illustrates a bottom portion of two-door commercial cabinet 1 with a right side door 2 and a left side door 3 thereupon. The cabinet can be supported by legs or feet 5, or by casters (not shown). The right-side door and left-side door are provided with hinges 4 at outer portions thereof, so that the doors swings outwardly from a center section or center post 6. Instead of center post 6, however, the doors may join and seal at the center. FIG. 1 also indicates a right-side foot pedal 7 and a corresponding actuator member 8, which work together to open left-side door 3 when right-side pedal 7 is actuated. Left-side pedal 9 is connected to actuator member 10, to open the right-side door 2 when left-side pedal 9 is actuated. In the illustrated embodiment, the foot pedals 7 and 9 and actuator members 8 and 10 are disposed on a mounting plate 11, which is secured to a bottom portion of cabinet 1. In an alternative embodiment, the pedals and actuators can be secured directly to the cabinet.

Figure 2:
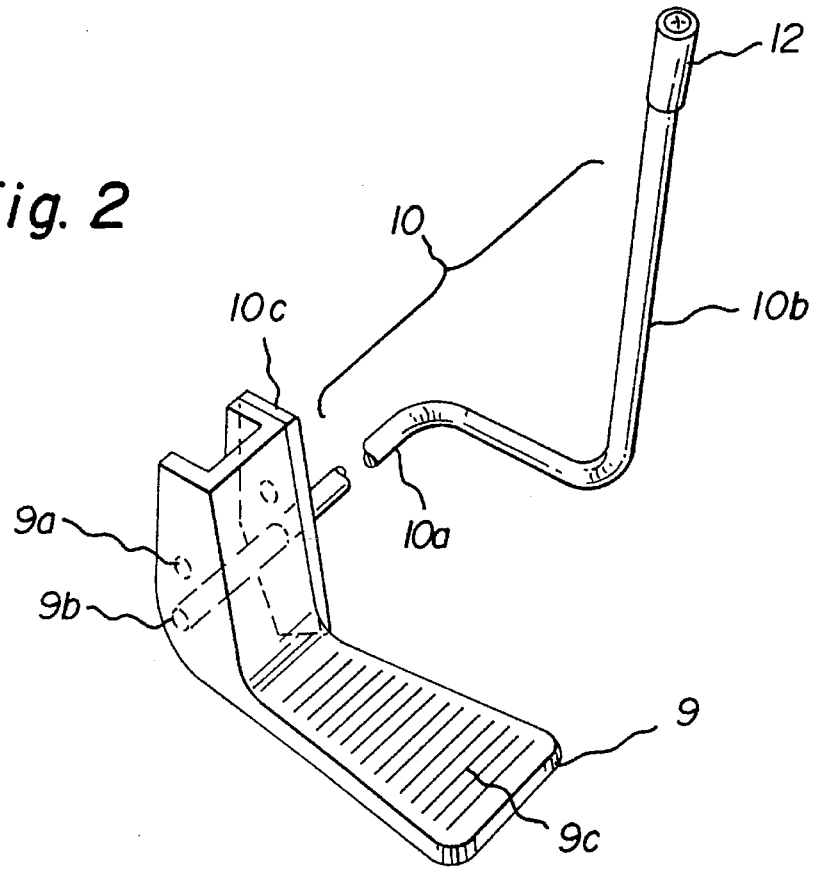
FIG. 2 is a perspective view of a left side pedal assembly, according to the invention.
Figure 3:
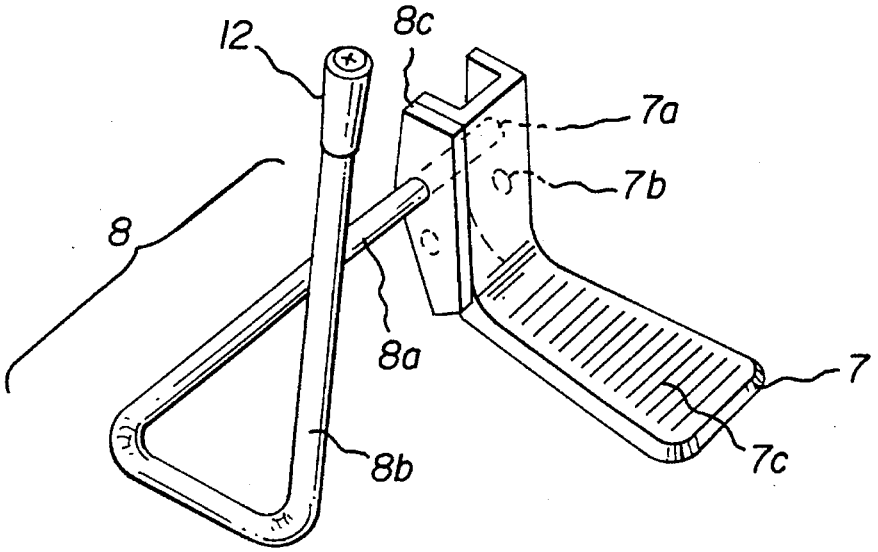
FIG. 3 is a perspective view of the right side pedal assembly, according to the present invention.
Figure 4:
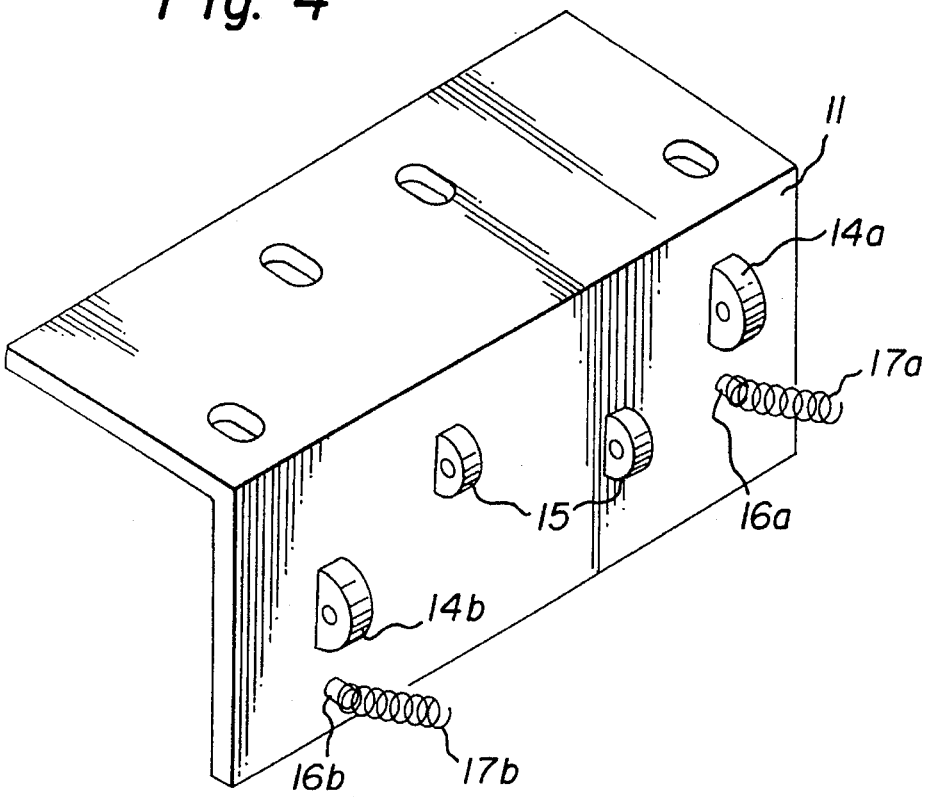
FIG. 4 is a perspective view of a mounting plate or mounting bracket for the present invention.

FIGS. 2 and 3 illustrate perspective views of the left-side and right-side pedals, respectively. FIG. 2 illustrates left-side pedal 9 which is attached to actuator member 10. Actuator member 10 comprises rotating portion 10*a*, which rotates when pedal 9 is actuated, and engagement member 10*b* which pivots or swings when the pedal is actuated. When installed on the cabinet or mounting plate, rotating portion 10*a* helps form a pivot point upon which pedal 9 pivots; pedal 9 is fixedly connected to rotating portion 10*a* by a suitable fastening method, such as via a "T" fastening flange 10*c* which is fixed to rotation portion 10*a*, and is assembled or fastened to pedal 9, thereby transferring actuating motion from pedal 9 to rotation member 10*a*. Instead of flange 10*c*, rotation portion 10*a* can be welded or directly connected to pedal 9. Another method of transferring actuating motion from the pedal to the rotation member can be seen in FIG. 5, wherein an end of actuating member 10 has a flattened portion, creating a "D"-shaped cross section, and wherein this D-shaped cross section fits into a corresponding "D"-shaped aperture 23 in each of the pedals; the flattened portion therefore prevents rotation of the actuator member within the aperture, and allows actuating motion to be transferred from the pedal to the actuating member. In this configuration, a cotter pin or similar retaining device can be used to prevent lateral movement of the actuator linkage and facilitate assembly and disassembly at the linkage. A distal end of actuator member 10 includes a protective member 12 at an end thereof. Protective member 12 can be a pad, a sleeve, or other member of a shock absorbing or sound deadening material. Upon an actuation of pedal 9, and a resultant pivoting of actuating member 10, protective member 12 engages the right-side cabinet door, thereby pushing the door in an outward direction. Actuator members 8 and 10 can be supported as shown in FIG. 1 via a central bearing block 13, or by individual linkage bearing points 15 as shown in FIG. 4. These bearings can be split bearings for easy assembly, or a cylindrical bearing which slides onto or around the actuator member.

FIG. 3 illustrates the right-side pedal assembly, with the corresponding elements thereof. FIG. 3 is essentially a mirror image of the left-side pedal assembly of FIG. 2. However, it can be seen in both FIGS. 2 and 3 that, in one embodiment, pedals 7 and 9 each have two sets of apertures therein. Pedal 9 has apertures 9*a* and 9*b*, and pedal 7 has apertures 7*a* and 7*b*. Actuator 10 of the left-side pedal assembly is disposed in a lower aperture 9*b* of pedal 9; actuator 8 of the right-side pedal assembly, however, is disposed in an upper aperture, aperture 7*a*, of pedal 7. The relationship of these apertures ensures that actuators 8 and 10 will be disposed in the overlapping, non-interfering relationship shown in FIG. 1. In order to further ensure that the actuator members operate in a non-interfering relationship, engagement members 8*b* and 10*b* include a compound configuration or bends therein, such that when the pedal assemblies are mounted on the cabinet or on the mounting plate, the engagement members are offset from the adjacent rotating member, so that interference therebetween is prevented.

Figure 5:
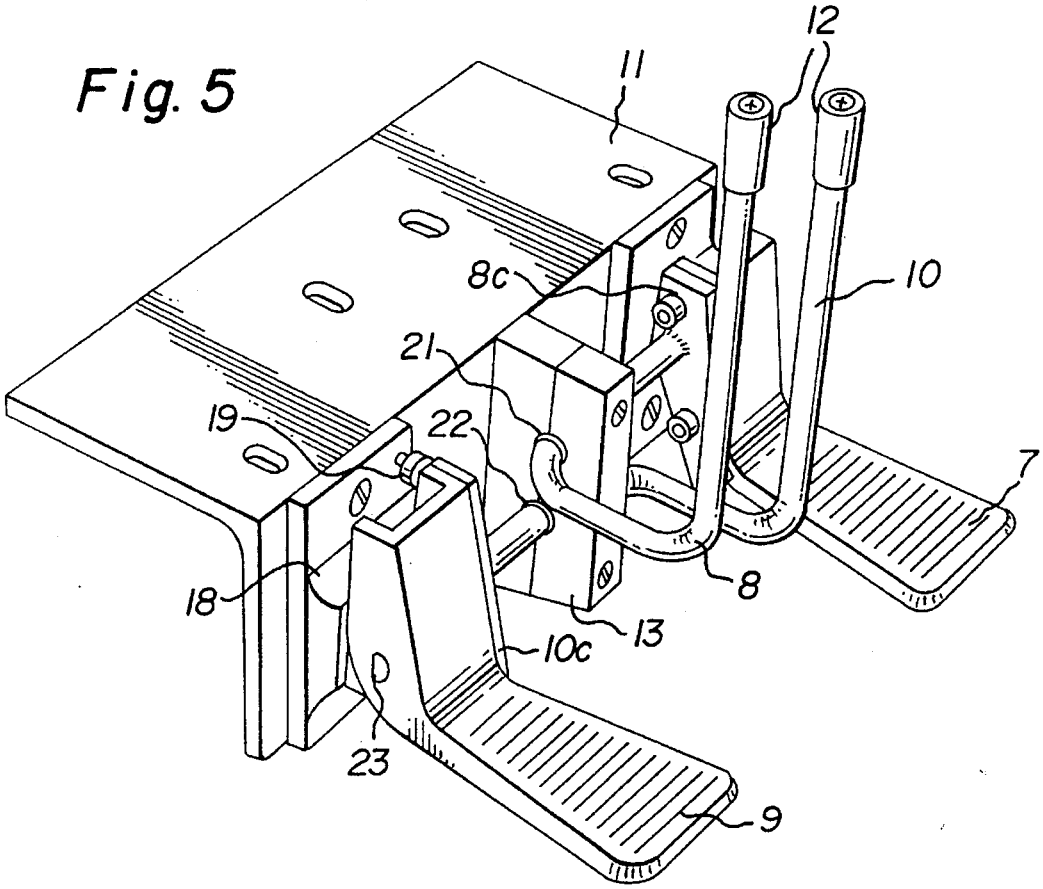
FIG. 5 is a perspective view of the present invention, including an alternative embodiment of the pedal mounting portion thereof.

FIG. 4 illustrates one configuration of mounting plate 11. Pedal bearings 14*a* and 14*b* are disposed at offset positions such that rotating members 8*a* and 10*a* can pass through holes in the pedal bearings, in such a manner that the pedals will be supported at an even height therefrom. Referring to FIG. 3, it can be seen that rotating portion 8*a* is disposed in an upper aperture 7*a* of pedal 7. This rotating member is passed through an aperture in pedal bearing 14*a*, forming a hinge between pedal 7, rotating member 8*a*, and pedal bearing 14*a*. Left-side pedal 9 has rotating member 10*a* passed through lower aperture 9*b* thereof. Therefore, pedal bearing 14*b* is disposed at a lower position than pedal bearing 14*a*. Pedal 9, rotating member 10*a*, and pedal bearing 14*b* are configured such that a hinge is formed therebetween, and such that pedal 9 is disposed at a same height as pedal 7. As mentioned earlier, the rotating members can be supported in linkage bearing points 15 as shown in FIG. 4, or in a bearing block 13 as shown in FIGS. 1 and 5. These linkage bearing points 15, or bearing block 13, can support the actuator members in bushings or bearings, as shown in FIG. 5. Reference number 21 illustrates the use of a cylindrical or sleeve type bearing, supported in bearing block 13, and rotatably supporting actuator member 8 therein. Reference number 22 illustrates a split type bushing or bearing supporting actuator member 10 within bearing block 13. This combination of split and sleeve bearings is shown for illustration purposes only. In practice, either a pair of sleeve or cylindrical type bushings or bearings will be used, or a pair of split type bushings or bearings will be used. These bushings or bearings may be made of metal, a composite material, a plastic such as nylon or Delrin, or any other suitable material.

Below pedal bearings 14*a* and 14*b* are disposed spring retainers 16*a* and 16*b*. These spring retainers are projections or depressions which are intended to accommodate an end of coil springs 17*a* and 17*b*, respectively. These coil springs act to bias the respective pedals such that when the pedals are depressed and actuated, the pedals are springably returned upward to a normal position. The coil springs can be replaced with another suitable springing means or device, such as a leaf spring, torsion spring, etc.

As shown in FIG. 5, pedal bearings 14*a* and 14*b*, as well as spring retainers 16*a* and 16*b* (not shown in this figure), can alternatively be disposed on pedal mounts 18, which can be fastened to mounting plate 11. FIG. 7 illustrates an embodiment of pedal mounts 18, wherein an upper portion 18*a* is separable from a lower portion 18*b*, to allow access to the pivot pin or actuator member which pivotably supports the pedal, and/or a bearing which supports the pivot point. As discussed above with respect to bearings 21 and 22, the bearing can be a cylindrical bearing, or a split type bearing as shown in FIGS. 8*a* and 8*b*. Pedal mounts 18, or mounting plate 11, can be provided with pedal adjusters 19, for adjusting a pivot distance of the pedals. These pedal adjusters may be, for example, threaded shafts fitting into correspondingly threaded holes, for adjusting an amount of "play" or distance of travel of the pedal.

FIGS. 8*a* and 8*b* show a front view and a side view (axial view), of a split type bearing which can be used to support the actuating member or pivot point for pedals 7 and 9, and/or support the actuator members in bearing block 13. This type of split bearing is illustrated as split bearing 22 in FIG. 5. Referring again to FIGS. 8*a* and 8*b*, split bearing 22 comprises an upper portion 22*a* and a lower portion 22*b*, and are disposed to surround the rotating shaft in an appropriate pedal mount or bearing block.

In an another alternative embodiment of the present invention, as shown in FIG. 6, pedals 7 and 9 may be mounted on pivot pins or pivot points 20 which are not part of actuator members 8 or 10, but which cooperate with pedal bearings 14*a* and 14*b*. Actuator members 8 or 10 would then terminate in "T" flange 8*c* or 10*c* which would be bolted to opposing sides of each of pedals 7 and 9, respectively, such that the actuator members then rotate as discussed above when each of pedals 7 and 9 are operated as will be discussed below. For proper rotation, the rotating axes of each of the actuator members are preferably aligned with the pivot axes of pivot points 20. The configuration discussed above, wherein the actuator members, pivot points, bearings/bearing blocks, etc., are mounted on mounting plate 11 facilitates complete field replacement of the entire assembly with minimal labor. A completely assembled mounting plate 11, having the various actuator members, pedals, and bearings thereupon, can be unbolted from a two-door commercial cabinet in the field, and a new assembly can be replaced therewith.

In operation, if a user were seeking to open left hand side door 3, the user could walk straight up to the front of the cabinet, and, standing in front of right-side cabinet 2, pedal 7 could be depressed by the foot of the user. Pedal 7 would therefore hinge by virtue of rotating member 8*a* and pedal bearing 14*a*, thereby rotating the rotating member 8*a*, which is stably supported by linkage bearings 15 or bearing block 13, and swing or pivot the engagement member 8*b* to push the left-side door open or outward. After the door is open, the user can easily access the interior of the cabinet. Similarly, in order to open the right-side door, the user would stand in front of left side door 3, and depress pedal 9. Pedal 9 would pivot at pedal bearing 14*b* to rotate the rotating member 10*a*, to swing the engagement member 10*b*, to engage and open the right-side door 2.

FIGS. 2 and 3 indicate the actuator members 8 and 10 as being a single piece of material; these members can be bent from a single piece of metal, such as steel or aluminum; these members can also be made from separate sections of metal or other suitable material, and attached at various points by a suitable attaching means or method such as welding, clamping, pressing, etc. Protective member 12 is optional, and can be in the form of a rubber or plastic cap or cover, and can also be integrally formed in the distal end of the actuator members, to provide a suitable contact point therefore.

Pedals 7 and 9 can be of any suitable cast, stamped, or molded material, and can have tread portions 7*c* and 9*c* molded, cut, or attached thereupon.

As evident from the foregoing description, a number of modifications not specifically disclosed herein could be made to the device, but still be within the intended scope of the invention. To determine the scope of the invention, therefore, reference should be made to the appended claims.

We claim:

1. A foot pedal door opener device for a commercial cabinet having side-by-side doors, said device comprising:

a cabinet housing having at least a left side door and a right side door;

a right side foot pedal for opening the left side door of the cabinet housing, said right side foot pedal being pivotably attached to a first pivot point on the cabinet housing;

a left side foot pedal for opening the right side door of the cabinet housing, said left side foot pedal being pivotably attached to a second pivot point on the cabinet housing which is adjacent said first pivot point;

a first actuator member fixedly attached to said right side foot pedal, said first actuator member being disposed to engage said left side door when said right side foot pedal is actuated, thereby opening the left side door;

a second actuator member fixedly attached to said left side foot pedal, said second actuator member for engaging said right side door when said left side foot pedal is actuated, thereby opening the right side door;

wherein said first actuator member extends from said right side foot pedal toward said left side foot pedal, and said second actuator member extends from said left side foot pedal toward said right side foot pedal, such that a portion of the actuator members are in an overlapping, non-interfering relationship.

2. A foot pedal door opener device as recited in claim 1, further comprising:

biasing means for biasing said right side foot pedal and said left side foot pedal wherein said foot pedals return to an original position after being actuated to open the doors of the cabinet housing.

3. A foot pedal door opener device as recited in claim 2, wherein said biasing means comprises a first coil spring disposed between said right side pedal and the cabinet housing, and a second coil spring disposed between said left side foot pedal and the cabinet housing.

4. A foot pedal door opener device as recited in claim 2, further comprising:

at least one pedal adjustment means for adjusting a distance of travel of at least one of said right and left side foot pedals.

5. A foot pedal door opener device as recited in claim 4, wherein said at least one pedal adjustment means comprises a threaded shaft threadably engaging a correspondingly threaded aperture, adjacent said at least one of said right and left pedals.

6. A foot pedal door opener device as recited in claim 1, wherein said first pivot point and said second pivot point are disposed on a mounting plate, and said mounting plate is fixedly attached to the cabinet housing.

7. A foot pedal door opener device as recited in claim 6, wherein said right and left side foot pedals, and said first and second actuator members can be preassembled on said mounting plate, and said mounting plate can be removed and reattached to the cabinet housing.

8. A foot pedal door opener device as recited in claim 1, wherein said first actuator member comprises a first rotating portion extending from a side of said right side foot pedal toward said left side foot pedal, and a first distal portion extending at an acute angle from said first rotating portion, said first distal portion pivoting when said right side foot pedal is actuated to engage and open said left side door; and wherein said second actuator member comprises a second rotating portion extending from a side of said left side foot pedal toward said right side foot pedal, and a second distal portion extending at an acute angle from said second rotating portion, said second distal portion pivoting when said left side foot pedal is actuated to engage an open said right side door.

9. A foot pedal door opener device as recited in claim 8, wherein said first distal portion is disposed at a right angle to said first rotating portion, and wherein said second distal portion is disposed at a right angle to said second rotating member, and wherein said first and second distal portions are shaped so as to be in a non-interfering relationship with said second and first rotating portions, respectively.

10. A foot pedal door opener device as recited in claim 8, further comprising bearing block means for supporting said first and second rotating portions, said bearing block means being attached to a mounting plate fixedly attached to said cabinet housing, and having bearing holes to rotatingly support said first and second rotating portions.

11. A foot pedal door opener device as recited in claim 10, wherein said bearing holes form bushings to rotatingly support the first and second rotating portions.

12. A foot pedal door opener device as recited in claim 10, wherein said bearing holes include bearings to rotatingly support said first and second rotating portions.

13. A foot pedal door opener device as recited in claim 12, wherein at least one of said bearings is a split bearing, to facilitate easy removal and replacement of the at least one bearing and a corresponding actuator member.

14. A foot pedal door opener device as recited in claim 8, wherein said first rotating portion and said right side foot pedal pivot on a first common axis, and wherein said second rotating portion and said left side foot pedal rotate on a second common axis.

15. A foot pedal door opener device as recited in claim 1, wherein said first and second actuator members include engagement pads on distal ends thereof, said engagement pads forming a contact point between each of said actuator members and the respective doors upon an actuation of respective foot pedals.

16. A foot pedal door opener device as recited in claim 1, wherein said right side foot pedal and said left side foot pedal include non-skid means for preventing a foot of an operator from slipping off an engagement surface of each of said foot pedals.

17. A foot pedal door opener device as recited in claim 1, wherein the cabinet housing comprises a refrigerated cabinet.

18. A foot pedal door opener device as recited in claim 1, wherein said actuator members comprise metal.

19. A foot pedal door opener device as recited in claim 1, wherein said actuator members comprise plastic.

20. A foot pedal door opener device as recited in claim 1, wherein said actuator members comprise composite material.

21. A foot pedal door opener device as recited in claim 1, wherein the cabinet housing comprises a thermally controlled cabinet.

22. A foot pedal door opener device as recited in claim 4, wherein said first pivot point and said second pivot point are formed on pedal mounting platforms, said pedal mounting platforms being removably disposed on said mounting plate.

* * * * *